United States Patent [19]

Hain

[11] 4,014,594

[45] Mar. 29, 1977

[54] HEADREST FOR OPERATORY CHAIR

[75] Inventor: Larry A. Hain, Columbia, Pa.

[73] Assignee: Dentsply Research & Development Corporation, Milford, Del.

[22] Filed: Jan. 2, 1976

[21] Appl. No.: 646,303

[52] U.S. Cl. ..... 297/408; 297/391

[51] Int. Cl.[2] ..... A47C 1/10

[58] Field of Search ..... 297/218, 391, 396, 408, 297/409, 444

[56] References Cited

UNITED STATES PATENTS

| | | | |
|---|---|---|---|
| 3,037,814 | 6/1962 | Gardner et al. | 297/444 |
| 3,603,642 | 9/1971 | Laessker | 297/408 |
| 3,936,091 | 2/1976 | Rabinowitz | 297/408 X |

*Primary Examiner*—James C. Mitchell

*Attorney, Agent, or Firm*—C. Hercus Just; J. Wm. Berkstresser

[57] ABSTRACT

An angularly adjustable headrest for an operatory chair having means to quickly and effectively latch and unlatch the headrest pad relative to the supporting member incident to positioning the headrest member at a desired angle relative to the back of the chair.

10 Claims, 8 Drawing Figures

HEADREST FOR OPERATORY CHAIR

BACKGROUND OF THE INVENTION

The present invention pertains to a headrest which is attachable to the upper end of the back of a chair used in operatories such as those employed by various segments of the medical profession, including dentistry. A chair for an operatory of such type specifically is an article of furniture. The current trend in regard to professional furniture of many types is to render the same more comfortable as well as more efficient in use. To achieve this objective, there has been considerable effort expended in recent years in the upholstery applied to operatory chairs, and the addition of upholstery to headrests employed on such chairs also has been undertaken but has created certain problems, particularly in the area of mechanism by which the angular position of the headrest with respect to the chair back is achieved and maintained when a desired position has been reached.

Among the attempts previously undertaken to provide comfort in a headrest designed for an operatory chair are the structures comprising the subject matter of the following patents.

U.S. Pat. No. 3,603,642, to Laessker, dated Sept. 7, 1971, discloses a padded or upholstered headrest which is angularly adjustable about a horizontal axis, the adjustment being effected by a manually operated pushbutton disposed only at one side of the headrest. In modern operatory techniques, it is quite common to not only have the doctor or dentist adjust the headrest but the same also quite frequently is adjusted by the assistant to the doctor or dentist. Depending upon the side where the doctor, dentist or assistant is located at the time an adjustment is needed, it may be that the individual making the adjustment will have to move to the opposite side of the chair to undertake the adjustment.

U.S. Pat. No. 3,719,388, to Fortnam, dated Mar. 6, 1973, discloses an upholstered headrest having a ball and socket supporting arrangement, and adjustment is effected by means of a manually operated handle extending only from one side of the headrest, whereby this structure has the same requirements of operation as the Laessker patent referred to above.

U.S. Pat. No. 3,813,151, to Cadiou, dated May 28, 1974, discloses an adjustable headrest attached to the upper end of the back of a seat for a vehicle in which the headrest is pivoted about a horizontal axis but adjustment is effected by a manually operable knob exposed adjacent one side of the headrest only, whereby the same is incapable of operation from both sides of the headrest.

U.S. Pat. No. 3,817,576, to Ciavattoni, dated June 18, 1974, also shows a dental chair with a pivotally adjustable headrest in which the adjustment is maintained by a centrally disposed, angular finger which must be positioned selectively in one of a row of slots in order to secure the same in a desired position of adjustment.

Especially for purposes of providing structurally strong and easily operated positioning mechanism for an angularly adjustable headrest at the upper end of the back of an operatory chair and particularily to render the operation of the headrest equally from either side thereof, the present invention has been developed and details thereof are described hereinafter, as follows.

SUMMARY OF THE INVENTION

It is one principal object of the invention to provide in an adjustable headrest for the back of an operatory chair adjustable positioning means which is capable of being operated by a minimum amount of movement of co-engageable clutch members having complementary serrations on the mating faces of the clutch members, one of said clutch members being stationary and the other being movable, and the movable clutch member being actuated by manually engageable means positioned centrally of the rear surface of the headrest, whereby the same is accessable equally from either side edge of the headrest.

It is another object of the invention to provide in the clutch-operating mechanism for the headrest a member having crank arms respectively on opposite ends thereof and one of said arms being longer than the other for purposes of affording mechanical advantage and thereby requiring a minimum of manual force to operate the clutch disengaging means for moving the movable clutch member to inoperative position.

It is a further object of the invention to provide in conjunction with the clutch-operating mechanism for the headrest, movement limiting means which determines the maximum movement of the headrest relative to the supporting means therefor in opposite directions.

Still another object of the invention is to provide improved means to key the movable clutch member relative to the headrest to prevent relative rotatable movement between said clutch member and the headrest, while the stationary clutch member is fixed against rotation relative to the support for the headrest, the pivotal movement between the headrest and support being on a horizontal axis.

A still further object of the invention is to provide improved means for securing the upholstered cover member of the headrest to a back member of said headrest so as to enclose the clutch-type adjustable positioning means between the headrest and the support member therefor.

Details of the foregoing objects and of the invention, as well as other objects thereof, are set forth in the following specification and illustrated in the accompanying drawings comprising a part thereof.

DETAILED DESCRIPTION

Figure 1:
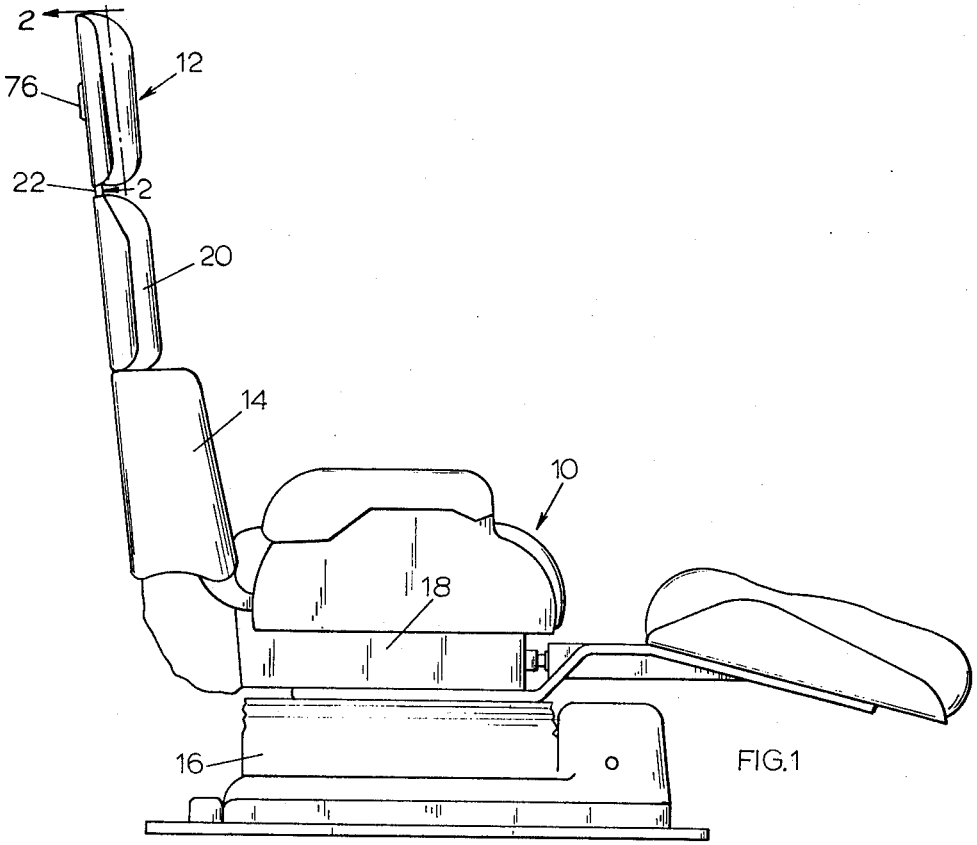
FIG. 1 is a side elevation of an exemplary operatory chair in which a headrest is illustrated in operative position at the upper end of the back of the chair, said headrest embodying the operating mechanism comprising the present invention.

Referring to FIG. 1, there is illustrated therein an operatory chair 10 which, specifically, comprises a dental chair but it's to be understood that the headrest 12 and its supporting mechanism, which is shown at the upper end of the back 14 of the chair may be used on other types of operatory chairs and particularly those employed in the medical profession, as well as in barber and beauty shop operations. The chair 10 comprises a base 16 upon which a seat 18 is supported for vertical adjustment, and the back 14 is pivotally connected to the rear portion of the seat 18. In the illustration shown in FIG. 1, the back 14 also has an upper section 20 and the headrest 12 is connected to the upper end of the section 20 of the back 14.

Figure 2:
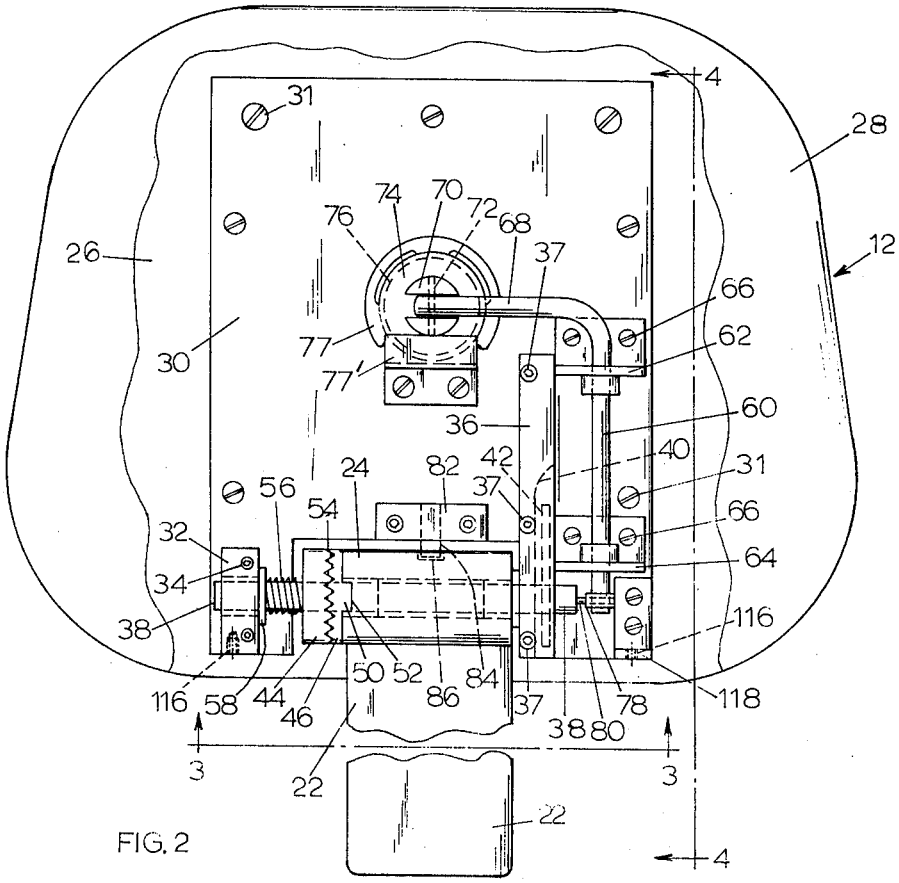
FIG. 2 is a fragmentary plan view of the interior of the headrest shown in FIG. 1 as seen on the line 2—2 thereof, part of the upholstery of the headrest being broken away in FIG. 2 and the support member for the headrest being foreshortened to accommodate the same to the sheet.
Figure 4:
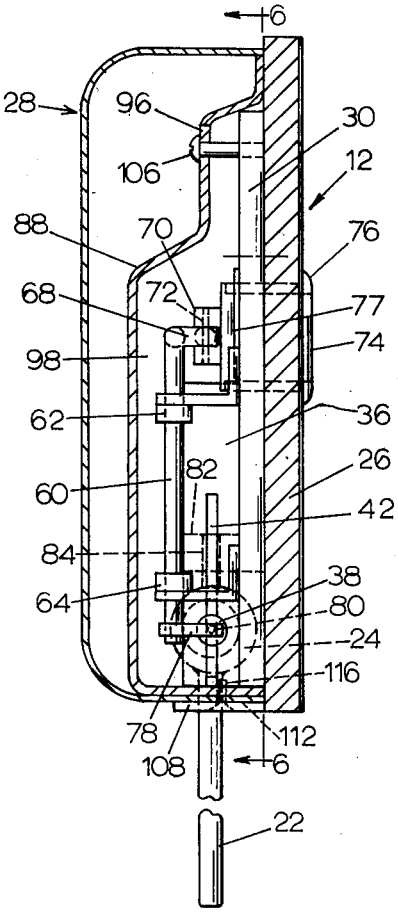
FIG. 4 is a vertical sectional view of the headrest shown in FIG. 2 at seen on the line 4—4 thereof.
Figure 5:
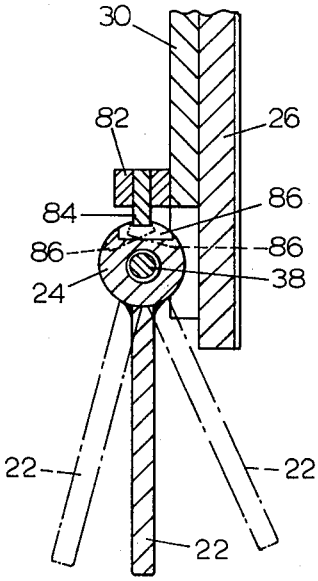
FIG. 5 is a fragmentary vertical sectional elevation of the mechanism shown in FIG. 3 as seen on the line 5—5 thereof.

As indicated above, the present invention pertains to the headrest 12 and the means which supports the same comprising an elongated supporting member 22 which is shown in foreshortened manner in FIGS. 2, 4 and 5. The member 22 preferably is formed from metal and is of uniform width and thickness in order to be slidably mounted within an appropriate socket, not shown, extending downwardly from the upper end of the upper section 20 of the back 14. If desired, suitable locking means may be employed to retain the member 22 at any desired longitudinal position within said socket but, under other circumstances, the member 22 may be supported within the socket by gravity alone.

Secured to the normally upper end of the supporting member 22 is a sleeve 24 which is rigidly attached thereto. In the prefered construction, as shown in FIG. 2, the sleeve 24 is substantially the same length as the width of the supporting member 22, especially for purposes of compactness. Said sleeve pivotally supports the headrest 12 which comprises a base member 26 which may be formed from any suitable, preferably rigid material, such as plywood, metal, plastic or synthetic resin, or otherwise. The headrest 12 also comprises an upholstered unit 28 which is padded resiliently for comfort to the patient whose head is in contact with the headrest. The outline of the upholstered unit 28 is as illustrated in FIG. 2 and, similarly, the outline of the base member 26 is substantially equal to that of the upholstered unit 28 as shown in FIG. 2.

Fixed to the inner surface of the base member 26 is a preferably metal plate 30 which, for example, may be secured to the base member 26 by a plurality of screws 31 or the like. Adjacent the lower left hand corner of plate 30 as shown in FIG. 2 is a short vertical rib 32 which is secured to the plate 30 by screws 34. A somewhat longer rib 36 also is secured to the plate 30 in parallel relationship to the rib 32 and spaced a substantial distance to the right thereof as viewed in FIG. 2 for purposes of accommodating between the ribs 32 and 36 the sleeve 24. Rib 36 is secured to plate 30 by suitable screws 37. Ribs 32 and 36 also have axially aligned bearings of the same diameter for purposes of receiving there between shaft 38, said shaft also extending through the central bore of the sleeve 24.

It is preferred that the shaft 38 be nonrotatable with respect to the headrest 12 and to accomplish this conveniently and simply, the rib 36 is provided with a longitudinally extending slot 40 and an elongated pin 42, best shown in FIG. 2, is disposed within the slot 40, the depth of the slot also being sufficient to permit limited movement of the pin 42 in the slot in the direction transverse to the axis of the said pin, for purposes to be described. It will be seen from this construction however that the disposition of the pin 42 within the slot 40, together with the fixed connection of the rib 36 to the metal plate 30 and the fixed connection thereof to the base member 26 of the headrest 12, will result in the shaft 38 being nonrotatable relative to the headrest 12 but shaft 36 is arranged for limited axial movement within the bearings in ribs 32 and 36 as well as within the central bore of the sleeve 24, for purposes described hereinafter.

Figure 3:
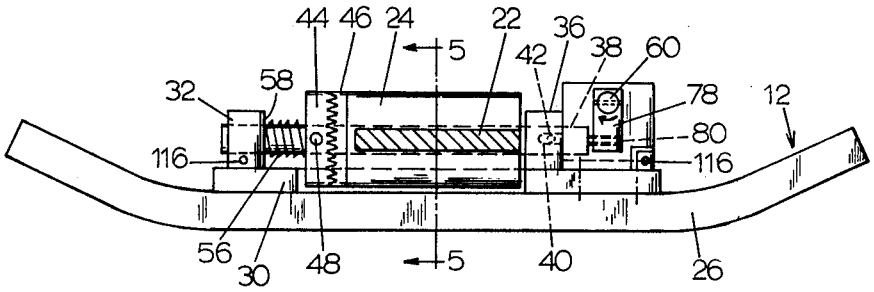
FIG. 3 is a transverse elevation seen from the lower end of the headrest shown in FIG. 2 as viewed on the line 3—3 thereof.

The means for positioning the headrest at a desired, adjusted angle with respect to the supporting member 22 comprises a pair of mating clutch members 44 and 46. Clutch member 44 is fixed relative to shaft by any suitable means such as a pin 48 which is shown in FIG. 3, and clutch member 46 is stationary with respect to the supporting sleeve 24 which is rigidly connected to the elongated supporting member 22. From FIG. 2, it will be seen that clutch member 46 is provided with a pair of lugs 50, only one of which is shown in FIG. 2, said lugs being diametrically opposite the axis of shaft 38 and said lugs are received in a pair of complementary notches 52 formed in one end of sleeve 24 as also is seen in FIG. 2. The adjacent faces of the clutch members 44 and 46 are provided with complementary radially extending serrations 54 which preferably are of a sharp ridge nature and relatively fine pitch in order that effective clutching engagement may be effective between the two even though the axial movement of clutch member 44 relative to stationary clutch member 46 is of a very limited nature which, for example, in actual practice, may be of the order of less than one eighth inch. The clutch members are maintained in engaged relationship by means of a spring 56 which surrounds shaft 38 and opposite ends thereof respectively about the outer face of movable clutch member 44 and a bushing 58 which is mounted within a bore in the short vertical rib 32 and comprises a bearing for the left hand end of shaft 38 as viewed in FIG. 2. Due to clutch member 44 being secured against rotation on shaft 38 and the pin 42 in slot 40 preventing rotation of said shaft relative to base member 26 and plate 30 of headrest 12, clutch member 44 is non-rotatable relative to the headrest.

One primary feature and characteristic of the present invention resides in the means by which clutch member 44 is separated from the relatively fixed clutch member 46. The actuating mechanism comprises an operating shaft 60 which is supported respectively adjacent its opposite ends within bearings 62 and 64 formed in brackets which are secured to the metal plate 30 by screws 66. The shaft 60 has one end 68 which is of appreciable length and is bent at a right angle to shaft 60. The outer end portion of the end 68 of the shaft 60 is received in a bifurcation formed in a lug 70 through which a locking pin 72 extends to secure the end 68 of the shaft to the lug 70. Lug 70 is formed on one end of an operating button 74 which is mounted co-axially within a bushing 76 which is exposed within aligned openings in metal plate 30 and base member 26 and is secured in said bores by snap ring 77. Inward movement of button 74 is limited by stop member 77' which is fixed to plate 30 as best shown in FIG. 2. Thus, the pin 72 also prevents removal of the button 74 from the bushing 76 except when such removal is desired.

The end of shaft 60 opposite the laterally extending end 68 is provided with a short crank arm 78, the length of which is best illustrated in FIG. 4 and it will be seen that the same is substantially shorter than the end 68 of shaft 60. One end of the crank arm is securely fixed to the shaft 60 and the opposite end thereof has a pin 80 therein, one end of which abuts the adjacent end of shaft 38 for actuating of the same in one axial direction for purposes of moving clutch member 44 out of engagement with fixed clutch member 46 and thereby permitting rotation of the headrest 12 of the axis of shaft 38 with respect to supporting member 22.

Referring to FIG. 2, it will be seen that the operating button 74 is mounted midway between the opposite sides of the headrest 12 and this constitutes one of the advantageous features of the present inventing due to the fact that the operating means for releasing the clutch mechanism is equally accessible from either side of the headrest in order that either the dentist or dental assistant may actuate the headrest when both are positioned in operating adjacent the chair or if a dentist, for example, is operating without the aid of a dental assistant, he may engage the operating button 74 from either side of the chair where he may be located at any given instant. Further, due to the much greater length of the arm end 68 of the shaft 60 as compared with the crank arm 78, a very substantial mechanical advantage is provided in order that relatively little manual force is required to depress the operating button 74 and thus disengage the movable clutch member 44 from the stationary clutch member 46 in order to permit pivotal movement of the headrest about the axis of shaft 38, to any degree permitted within the range provided by limiting means which are as follows.

Referring to FIGS. 2 and 5, it will be seen that another bracket 82 is on the plate 30 for purposes of supporting a stop member 84 which is substantially parallel to the metal plate 30 and laterally offset therefrom a short distance. The stop member 84 projects downwardly as viewed in FIGS. 2 and 5 and the terminal end thereof is received within a recess 86 which is formed in the upper end of sleeve 24 intermediately between the ends thereof. The opposite ends of the recess 86, as viewed in FIG. 5, respectively comprise the limits of pivotal movement permitted by the construction embodied in the headrest 12 and supporting member 22 but said limits are fully adequate to accommodate the headrest in all normal required positions thereof with respect to the supporting member 22.

Figure 6:
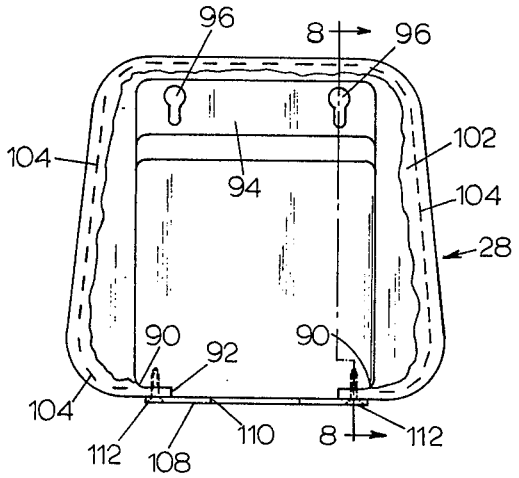
FIG. 6 is a plan view of the upholstered cover unit of the headrest as seen on the line 6—6 of FIG. 4 and illustrated on a smaller scale than employed in FIG. 4.
Figure 7:
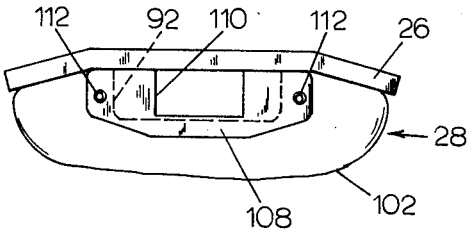
FIG. 7 is a transverse view of the bottom surface of the upholstered unit of the headrest shown in FIG. 6.

Another feature of the present invention which is an advantageous characteristic comprises the means by which the upholstered unit 28 is connected to the base member 26 for purposes of providing comfort to a patient whose head is engaged upon the upholstered unit 28 but also to enclose and protect the positioning means for the headrest described herein above. The details by which the upholstered unit 28 is detachably secured to the base member 26 are illustrated in FIGS. 4 and 6–8. From FIGS. 4 and 8 particularly, it will be seen that the upholstered unit 28 comprises a shaped plate or panel 88 which may be made from any suitable material, one preferred type comprising rigid synthetic resin or plastic material. The panel 88, at the lower end thereof, as viewed in FIGS. 6 and 8, has a transverse flange 90 which is interrupted intermediately of its ends to provide an elongated notch 92 which is outlined by a broken line shown in FIG. 7. This is for purposes of accommodating the supporting member 22 which extends through said notch. The panel 88, adjacent the opposite ends thereof, also is provided with a laterally offset section 94 which, as shown in FIG. 6, is provided with a pair of keyhole slots 96.

Figure 8:
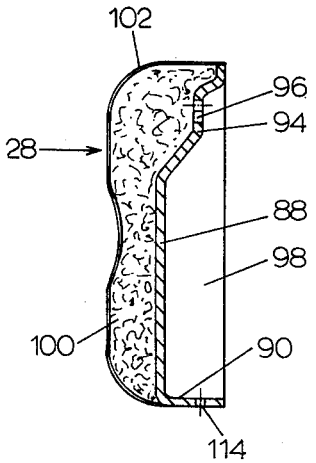
FIG. 8 is a vertical sectional view of the upholstered unit of FIG. 6 as seen on the line 8—8 thereof.

With reference to FIG. 8, it will be seen that the shape of the panel 88 is such as to provide a recess 98 which, particularly as seen from FIG. 4, accommodates the clutch mechanism and the actuating system by which the headrest is de-clutched by inward movement of the operating button 74. Clutching engagement of the clutch members is effected by releasing said button and permitting the spring 56 to firmly press the mating serrating surfaces of the clutch members into locking engagement with each other to prevent rotation of the headrest 12 relative to the supporting member 22.

The surface of the panel 88 opposite that which defines the recess 88 comprises the supporting surface against which the compressible upholstering material 100 is disposed, said material being enclosed by a sheet of flexible upholstery material 102 which extends around and overlaps the peripheral edges of the panel 88, said peripheral edge being suitably secured to the panel 88 by any appropriate means such as exemplary staples 104, shown in FIG. 6, adhesive, or otherwise.

The upholstered unit 28 is very readily connected to and removed from the operative position thereof by means of a pair of screws 106, shown in FIG. 2, the heads of which are extended through the enlarged ends of the keyhole slots 96 and the upholstered unit 28 then is moved upwardly to dispose the shanks of the screws within the narrower ends of the slots 96. When in this position, the supporting member 22 will be disposed within the elongated notch 92 at the lower end of the upholstered unit 28. A locking plate 108 which has a notch 110 therein is extended around the supporting member 22, as shown in end view in FIG. 4, the notch 110 therein accommodating the supporting member 22. A pair of screws 112 are provided which extend through suitable holes in the opposite end portions of the locking plate 108, said screws also extending through holes 114 and the transverse flange 90 of the panel 88 and the inner ends thereof being threaded into appropriate tapped holes 116, see FIG. 3, formed respectively in the lower end of short vertical rib 32 and a bracket 118, see FIG. 2, which is secured to metal plate 30. This arrangement firmly clamps the transverse flange 90 of the upholstered unit 28 against movement in any direction relative to base member 26 and metal plate 30 and thereby prevents the possibility of the keyhole slots 96 disengaging the screws 106. When it is desired to remove the upholstered unit 28 for any reason, it is only ncessary to remove the screws 112 and thereby dismount the plate 108, whereby the unit 28 may be lowered slightly to disengage the screws 106 from the narrow portions of the keyhole slots 96 and permit separation of the upholstered unit 28 entirely from the supporting means therefor.

While the invention has been described and illustrated in its several preferred embodiments it should be understood that the invention is not to be limited to the precise details herein illustrated and described since the same may be carried out in other ways falling within the scope of the invention as illustrated and described.

I claim:

1. A headrest for an operatory chair comprising in combination:

a. an elongated support member adapted to be attached to the back member of an operatory chair,
b. a headrest panel member of predetermined area,
c. a transverse journal bearing fixed to the normally upper end of said support member,
d. a shaft mounted within said bearing for rotatable and axial movement with respect thereto,
e. means on said shaft operable to prevent rotation thereof relative said panel member,
f. additional bearings on said panel member coaxial with said journal bearing and respectively receiving and supporting opposite end portions of said shaft for axial movement therein,
g. a pair of co-engageable frictional clutch members disposed coaxially upon said shaft,
h. means fixing said frictional clutch members respectively to said transverse journal bearing and said shaft, said frictional clutch members being disposed between one end of said transverse journal bearing and one of said additional bearings on said panel members,
i. elastic means engaging one of said frictional clutch members and normally urging the same into engagement with the other clutch member,
j. combination crank and shaft means supported by said panel member and operable to engage one end of said aforementioned shaft to move the same axially in a direction to disengage said frictional clutch members and thereby permit pivotal movement of said panel member relative to said elongated support, and
k. a manually engageable member supported by said panel member substantially centrally between the side edges thereof for equal accessibility from either edge of said panel member and engageable with said combination crank and shaft means to activate the same as aforesaid.

2. The headrest according to claim 1 in which said elastic means comprises a compression spring surrounding said shaft between one of said clutch members and one of said additional bearings on said panel member.

3. The headrest according to claim 1 in which said clutch members comprise rachet members having intermeshing teeth on adjacent surfaces thereof, said teeth being of similar shape and number, and said elastic means comprising a compression spring surrounding said shaft between one of said rachet members and one of said additional bearings on said panel member.

4. The headrest according to claim 1 in which said combination crank and shaft means includes a second shaft parallel to said panel member and the opposite ends thereof having crank arms thereon, said panel member also having additional bearings respectively receiving opposite end portions of said second shaft and said crank arms being disposed respectively outwardly beyond the said additional bearings.

5. The headrest according to claim 4 in which said crank arms on said second shaft are perpendicular to each other and one of said crank arms engaging one end of said axially movable shaft and the other crank arm being engageable by said manually engageable member supported by said panel member, whereby manual movement of said manually engageable member effects axial movement of said axially movable shaft.

6. The headrest according to claim 5 in which said manually engageable member comprises a plunger having an axis perpendicular to said panel member and supported for limited movement perpendicularly thereto.

7. The headrest according to claim 6 in which the crank arm engageable by said manually movable plunger is substantially longer than the other crank arm which engages one end of said axially movable shaft.

8. The headrest according to claim 1 in which said means to prevent rotation of said axially movable shaft relative to said panel member comprises keying means connected to said shaft and slidable in a guideway fixed relative to said panel member.

9. The headrest according to claim 8 in which said guideway is formed in one of said additional bearings on said panel member.

10. The headrest according to claim 1 further including movement-limiting stop means comprising a cooperating pin and slot to receive the same and disposed one on said panel member and the other on said transverse journal bearing provided on the upper end of said support member, said slot being in a plane substantially perpendicular to said panel member.

* * * * *